US008448358B2

(12) United States Patent
Lee et al.

(10) Patent No.: US 8,448,358 B2
(45) Date of Patent: May 28, 2013

(54) DEVICE COMPRISING A COATED METAL PLATE AND METHOD OF MANUFACTURING SUCH A DEVICE

(75) Inventors: Ya Ling Lee, Singapore (SG); Lingge Xu, Singapore (SG); Maarten Van Den Boogaard, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 254 days.

(21) Appl. No.: 12/992,111

(22) PCT Filed: May 8, 2009

(86) PCT No.: PCT/IB2009/051911

§ 371 (c)(1),
(2), (4) Date: Nov. 11, 2010

(87) PCT Pub. No.: WO2009/138937

PCT Pub. Date: Nov. 19, 2009

(65) Prior Publication Data

US 2011/0061272 A1 Mar. 17, 2011

(30) Foreign Application Priority Data

May 16, 2008 (EP) ..... 08156328

(51) Int. Cl.
*D06F 75/38* (2006.01)
*D06F 75/08* (2006.01)

(52) U.S. Cl.
USPC ..... 38/93; 427/455

(58) Field of Classification Search
USPC ... 38/74, 80–82, 88, 93, 94, 96, 97; 428/35.7, 428/457, 447; 427/446, 450–456
See application file for complete search history.

(56) References Cited

U.S. PATENT DOCUMENTS

| | | | | |
|---|---|---|---|---|
| 5,937,552 | A * | 8/1999 | Hall | 38/93 |
| 6,000,157 | A * | 12/1999 | De Beurs et al. | 38/93 |
| 6,360,461 | B1 * | 3/2002 | Blume et al. | 38/93 |
| 6,393,741 | B1 | 5/2002 | Bondy et al. | |
| 6,895,700 | B2 | 5/2005 | Lukas et al. | |
| 7,040,047 | B2 * | 5/2006 | Boulud et al. | 38/93 |
| 8,256,149 | B2 * | 9/2012 | Nathamuni Balaji et al. | 38/97 |
| 2003/0074814 | A1 | 4/2003 | Krings et al. | |
| 2006/0251837 | A1 | 11/2006 | Cnossen et al. | |
| 2009/0165341 | A1 * | 7/2009 | Janakiraman et al. | 38/82 |

FOREIGN PATENT DOCUMENTS

| | | | |
|---|---|---|---|
| DE | 4411790 | A1 | 10/1995 |
| EP | 0206121 | A1 | 12/1986 |
| EP | 0640714 | A1 | 3/1995 |
| WO | 9813544 | A1 | 4/1998 |
| WO | 02066728 | A2 | 8/2002 |

* cited by examiner

*Primary Examiner* — Ismael Izaguirre

(57) ABSTRACT

A device comprises a metal plate (4) and an element (2) for supporting the plate (4), wherein a portion (5) of the plate (4) is wrapped around the supporting element (2), wherein the plate (4) is coated with a sol-gel coating having a thickness which is in a range of 25 to 60 micrometers. In a manufacturing process of the device, the metal plate (4) is attached to the supporting element (2) by subjecting at least a portion (5) of the plate (4) to a process of mechanical deformation, wherein the sol-gel coating is applied to the plate (4) prior to attaching the plate (4) to the supporting element (2). Tests have proven that it is possible to have both the relatively thick coating and the mechanical deformation of at least a portion (5) of the plate (4) to which the coating is applied, without the formation of cracks in the coating.

14 Claims, 1 Drawing Sheet

DEVICE COMPRISING A COATED METAL PLATE AND METHOD OF MANUFACTURING SUCH A DEVICE

FIELD OF THE INVENTION

The present invention relates to a device comprising a metal plate and an element for supporting the metal plate, wherein the metal plate is coated with a sol-gel coating, and to a method of manufacturing such a device.

BACKGROUND OF THE INVENTION

Non-flexible coatings such as sol-gel coatings and ceramic coatings are widely used on various devices, including domestic appliances such as irons and personal care appliances such as hair rollers. In the field of irons, coatings are applied on a sole plate of an iron in order to impart functional properties. For example, the glidability of an iron may be improved by having a coating on the sole plate. Furthermore, the coatings are applied for decorative purposes. Common materials of the sole plate include aluminum and aluminum alloys, due to their good heat transfer properties. Stainless steel can also suitably be used, due to its pleasing appearance. For this reason, stainless steel sole plates are mostly uncoated. However, such sole plates are less scratch resistant and have poor gliding, in particular on polyester fabrics.

Currently, various embodiments of iron sole plates exist. In one of the known embodiments, the sole plate only has a block of die-cast aluminum. In another of the known embodiments, besides an aluminum block, a thin metal plate is provided, which is attached to the aluminum block. There are various ways of attaching the thin metal plate to the aluminum block, as will be elucidated below, the thin metal plate being referred to as ironing plate.

In the first place, it is common practice to have an aluminum ironing plate, which is attached to the aluminum block by means of rivets and/or paste. During the attachment process, the ironing plate remains flat and does not experience any mechanical deformation. In the second place, the ironing plate may be a stainless steel plate. In that case, it is preferred for the ironing plate to have bent edges, which are used for attaching the ironing plate to the aluminum block by mechanically pressing and rolling the bent edges around the sole plate. In other words, the stainless steel ironing plate is wrapped around the aluminum block.

As stated in the foregoing, when stainless steel is applied, there is normally no coating. Nevertheless, embodiments having a coating are known in the art. For example, WO 98/13544 discloses an iron having a sole plate consisting of an aluminum block, wherein a thin stainless steel plate is secured to the sole plate. In this respect, beading, gluing together and applying mechanical fastening means such as screws, rivets etc. are mentioned as feasible ways in which the attachment of the thin stainless steel plate to the aluminum block may be effected. A manufacturing process of the known iron involves steps of providing the thin stainless steel plate with an anti-friction layer on one side and securing the thin stainless steel plate, with the uncoated side, to the aluminum block.

In respect of the anti-friction layer as mentioned, WO 98/13544 discloses that a sol-gel process may be used to apply the layer. Furthermore, WO 98/13544 discloses that the layer can be made in a thickness ranging from 10 to 25 micrometers, and that the thickness should in practice be less than 20 micrometers, since, as stated therein, undesirable crack formation in the layer may occur at higher thicknesses.

WO 02/066728 discloses an iron having a coated ironing plate, wherein the sol-gel coating may have a higher thickness, namely a thickness ranging from 35 to 90 micrometers. In this iron, the sole plate comprises aluminum, in accordance with what is known from WO 98/13544. Furthermore, a porous layer of aluminum oxide is provided in order to improve adhesion of the sol-gel coating to the sole plate, so that there is no risk of peeling off of the sol-gel coating. In particular, when the sol-gel coating is applied over the porous layer of aluminum oxide, the coating penetrates into the pores of the aluminum oxide, thereby creating some kind of interpenetrating network.

U.S. Pat. No. 6,895,700 discloses a sole plate which is directly provided with a sol-gel coating, wherein a surface to which the coating is applied is hardened, and the application of an ironing plate is omitted. The thickness of the layer is kept below 10 micrometers. U.S. Pat. No. 6,895,700 discloses that by doing so, a shock applied to the coating is transmitted to the hardened metal of the sole plate, which can safely resist shocks of substantial magnitude, so that breakage or deformation of the coating is prevented.

U.S. 2003/074814 discloses an iron comprising an aluminum soleplate which is provided with a coating which is provided by means of a sol-gel process. In particular, the sol-gel coating has a thickness of 35 to 90 micrometers.

DE 44 11 790 discloses an iron comprising an aluminum soleplate that is attached to a block consisting of a silicon-containing aluminum casting. The attachment is realized through a heat-resistant adhesive. Furthermore, it is possible that the attachment is additionally realized in a mechanical manner, namely by means of tin flaps which are part of the soleplate, and which are bent around the block during a manufacturing process of the iron.

EP 0 206 121 discloses that a process such as sandblasting may be carried out prior to a process for coating a domestic utensil, in order to ensure sufficient fixation of the coating.

EP 0 640 714 discloses an iron comprising a metal soleplate which is provided with an anti-friction layer of an inorganic polymer, which is provided by means of a sol-gel process.

SUMMARY OF THE INVENTION

It is an object of the present invention to provide a way of having a relatively thick sol-gel coating on a metal plate, on the one hand, and having an attachment of the metal plate to a supporting element exclusively on the basis of a process of mechanical deformation of at least a portion of the coated metal plate, on the other hand.

According to the present invention, a device comprising a metal plate and an element for supporting the metal plate is provided, wherein a portion of the metal plate is wrapped around the supporting element, wherein the metal plate is coated with a sol-gel coating, and wherein the thickness of the coating is in a range of 25 to 60 micrometers. As follows from the description of the state of the art, such a device was thought to be non-feasible for the reason that it was believed that stress would be incurred on the metal plate, causing cracks (micro cracks and/or macro cracks) in the coating that may appear immediately after a manufacturing process and propagate from a bent portion of the plate to other areas. However, tests which were performed in the context of the present invention, and which were related to a manufacturing process of an assembly of an aluminum sole plate and a coated stainless steel ironing plate for use in an iron, proved that the expected formation of cracks does not appear, and that a crack-free final product may be obtained. This surprising result constitutes an important achievement, as the advantages of an attachment of the metal plate on the basis of a partial mechanical deformation and an application of a sol-gel coating having a relatively high thickness are combined without introducing any new problems. When the present invention is applied, it is possible to omit various manufacturing processes of components to be used in irons which involve relatively high costs, such as processes in which aluminum plates undergo expensive electrochemical treatments.

Preferably, the thickness of the coating is lower than 50 micrometers. Hence, a preferred range of the thickness of the coating is a range of 25 to 50 micrometers.

In a feasible embodiment, the device according to the present invention constitutes at least a part of an iron in which the coated metal plate is intended to be used for contacting objects to be subjected to an ironing process and transferring heat to these objects. Normally, in such a case, the supporting element is constituted by the sole plate of the iron, which may be manufactured of die-cast aluminum, as has already been described in the foregoing. The iron may be of any known type, including steam irons and system irons.

In case it is desired to expose the coated metal plate to a high temperature during operation of the device according to the present invention, it is advantageous if a heat-conducting material is present between the metal plate and the supporting element.

Within the scope of the present invention, the type of metal of the metal plate may be any suitable type such as aluminum or stainless steel. However, the application of stainless steel is preferred. The reason for this being that, in practice, aluminum is subjected to a process of sandblasting before the coating is applied, and that it often appears that sandblasting particles stay behind on the aluminum. When residual particles are present, the appearance of the coating is affected, resulting in a high level of rejects. The rejects from the sol-gel coating process may be subjected to a rework process during which the coating is removed in another sandblasting process, and the aluminum is annealed and manually cleaned, but this leads to high costs.

By using stainless steel as a carrier of the coating, the above-mentioned problem of the high level of rejects can be solved. In practice, stainless steel plates are also subjected to a sandblasting process before the coating is applied. However, due to the fact that stainless steel is a harder material than aluminum, a lower roughness of the carrier can be achieved with less entrapment of residual particles, resulting in a cleaner carrier and a lower level of rejects of the sol-gel process. Consequently, costs can be saved. Moreover, stainless steel plate rejects can simply be recycled to form new stainless steel plates, namely by re-melting the plates, thereby minimizing rework costs.

For the sake of completeness, it is noted that sol-gel coatings and methods of applying these coatings are well known in the art and that therefore, no further elucidation is given here.

The present invention also relates to a method of manufacturing a device as described in the foregoing, wherein a metal plate and an element for supporting the metal plate are provided, wherein the metal plate is attached to the supporting element by subjecting at least a portion of the metal plate to a process of mechanical deformation, and wherein, prior to attaching the metal plate to the supporting element, a sol-gel coating is applied to the metal plate in a thickness which is in a range of 25 to 60 micrometers, preferably in a range of 25 to 50 micrometers.

In general, the process of mechanical deformation may be a wrapping process such as a pressing and/or rolling process. Advantageously, the metal plate is provided with a bent edge, which is wrapped around the supporting element. An advantage of having the bent edge is that the wrapping process is facilitated.

In a practical way of carrying out the method according to the present invention, prior to applying the sol-gel coating to the metal plate, the metal plate may be subjected to at least one pre-treatment such as sandblasting or annealing. An advantageous effect of sandblasting is that a rough surface is obtained, so that coating adhesion may be enhanced. By performing an annealing process, stress incurred from sandblasting and sheet forming may be relieved.

Within the scope of the present invention, the process of applying the sol-gel coating may take place in any suitable way, for example, by performing a spray coating process.

The above-described and other aspects of the present invention will be apparent from and elucidated with reference to the following description of a manufacturing process of an assembly of a sole plate and an ironing plate according to the present invention, which is intended to be used in an iron.

BRIEF DESCRIPTION OF THE DRAWINGS

The present invention will now be explained in greater detail with reference to the Figures, in which equal or similar parts are indicated by the same reference signs, and in which.

DETAILED DESCRIPTION OF EMBODIMENTS

The present invention will now be described in the context of manufacturing an assembly 1 of a sole plate 2 and an ironing plate 3, which is suitable to be applied in an iron (not shown). However, this does not mean that the invention is not applicable in the context of other assemblies and appliances.

Figure 1:
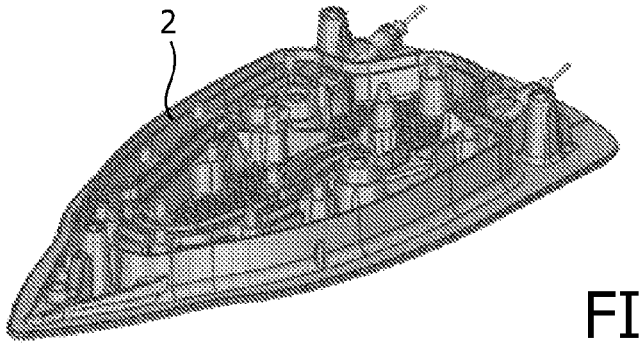
FIG. 1 shows a perspective view of a sole plate.
Figure 2:
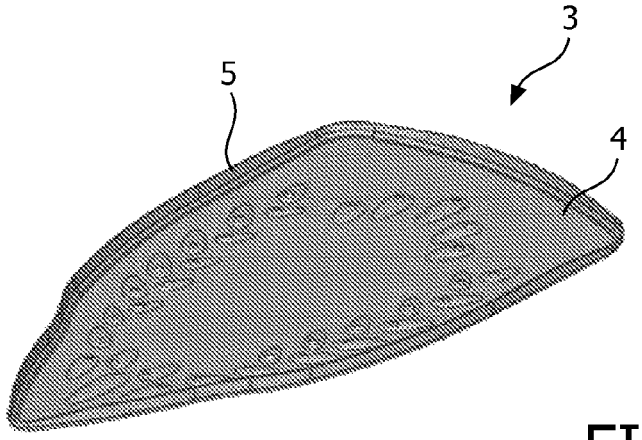
FIG. 2 shows a perspective view of an ironing plate which is to be attached to the sole plate shown in FIG. 1.
Figure 3:
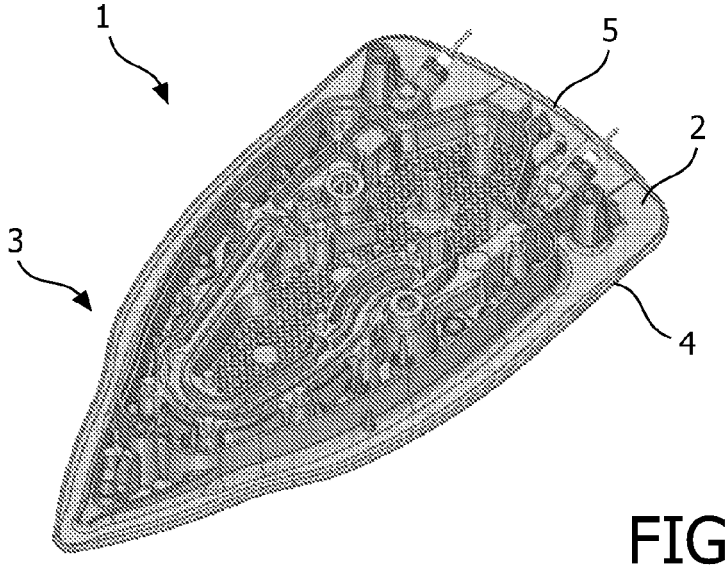
FIG. 3 shows an assembly of the sole plate shown in FIG. 1 and the ironing plate shown in FIG. 2.

An example of a sole plate 2 is shown in FIG. 1, and an example of an ironing plate 3 is shown in FIG. 2. In a practical embodiment, the sole plate 2 is formed as a block of die-cast aluminum, comprising various kinds of functional structures. For example, the sole plate 2 may comprise a space for receiving a heating element of the iron, a space which may be used as a chamber for generating steam, and a system for supplying water to this space, in a manner known per se. The ironing plate 3 comprises a metal plate 4, which may be a stainless steel plate, for example. Furthermore, in the shown example, the ironing plate 3 is provided with holes for letting through steam to an object to be ironed. In any case, the ironing plate 3 is intended for contacting such object and transferring heat to the object.

In tests which were performed in the context of the present invention, the ironing plate 3 was manufactured by performing the steps of providing a stainless steel plate 4, preparing one side of the plate 4 for being covered by a sol-gel coating by subjecting this side of the plate 4 to a suitable pre-treatment such as sandblasting, and performing a sol-gel process for actually applying the coating. In particular, the stainless steel plate 4 was subjected to sandblasting and annealing processes, after which a sol-gel system was spray coated onto the pre-treated stainless steel plate 4 and cured. The coating process was aimed at obtaining a layer thickness of the coating in a range of 25 to 60 micrometers.

In the case of mass production of the ironing plate 3, it is advantageous if a check is performed in order to find out whether the coating meets the requirements once the manufacturing process of the ironing plate 3 is finished. If this appears to be the case, the ironing plate 3 is ready to be attached to a sole plate 2. If this is not the case, the ironing plate 3 may be re-melted, so that a new plate may be formed.

Preferably, an edge 5 of the metal plate 4 which is part of the ironing plate 3 is bent, as shown in FIG. 2. In this way, it is achieved that the intended attachment of the ironing plate 3 to the sole plate 2, which involves wrapping the edge 5 of the metal plate 4 around the sole plate 2, is facilitated. In the shown example, the edge 5 is bent along the entire circumference of the metal plate 4. Furthermore, the ironing plate 3 has a substantially planar appearance, and the same may apply to a side of the sole plate 2 which is to be covered by the ironing plate 3.

During the tests, for the purpose of making the assembly 1 of the sole plate 2 and the ironing plate 3, a heat-conducting silicone paste was applied to the side of the sole plate 2 which was to be covered by the ironing plate 3, and the ironing plate 3 was put in place on the sole plate 2. Subsequently, mechanical pressing and rolling of the ironing plate 3 was performed, wherein the ironing plate 3 was wrapped around the sole plate 2, as the edge 5 of the stainless steel plate 4 of the ironing plate 3 was rolled around the sole plate 2.

When all processes as described were completed, the final assembly 1 of the sole plate 2 and the ironing plate 3 was examined for cracks and defects. No visual defects or cracks were found in the coating of the ironing plate 3. Examination for micro cracks was done by staining the ironing plate 3 and visualizing crack lines. No cracks were observed with the naked eye, and when the ironing plate 3 was examined with the help of a microscope, no cracks were found either.

The tests have shown that it is possible to manufacture an assembly 1 of a sole plate 2 and an ironing plate 3 comprising a stainless steel plate 4 and a sol-gel coating of a thickness in a range of 25 to 60 micrometers by wrapping the ironing plate 3 around the sole plate 2, while avoiding the formation of cracks in the coating. In particular, it appears to be well possible to realize a thickness in a range of 25 to 50 micrometers. As the sol-gel coating which is commonly used in the field of irons has a brittle, glass-like nature, this is a result which could not simply be expected on the basis of common general knowledge. Also, knowledge of relevant prior art seems to point away from the present invention rather than render it obvious.

In case the metal plate 4 is a stainless steel plate, good adhesion of the coating is obtained, and the level of rejects is relatively low, as the relatively hard stainless steel is not very susceptible to contamination by particles.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the Figures and the description, such illustration and description are to be considered illustrative or exemplary only, and not restrictive. The present invention is not limited to the disclosed embodiments.

Variations to the disclosed embodiments can be understood and effected by a person skilled in the art in practicing the claimed invention, from a study of the Figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

It is noted that the device according to the present invention may be any type of device comprising a metal plate having a sol-gel coating applied thereto. Feasible examples of the device according to the present invention are domestic appliances such as irons, grills, rice cookers, or pots and pans, and personal care appliances such as hair rollers, hair straighteners, depilators or shavers.

The present invention may be summarized as follows. A device comprises a metal plate 4 and an element 2 for supporting the metal plate 4, wherein a portion 5 of the metal plate 4 is wrapped around the supporting element 2, and the metal plate 4 is coated with a sol-gel coating having a thickness in the range of 25 to 60 micrometers. In a manufacturing process of the device, the metal plate 4 is attached to the supporting element 2 by subjecting at least a portion 5 of the metal plate 4 to a process of mechanical deformation, wherein the sol-gel coating is applied to the metal plate 4 prior to attaching this plate 4 to the supporting element 2. Tests have proven that it is possible to have both the relatively thick coating and the mechanical deformation of at least a portion 5 of the metal plate 4 to which the coating is applied, without the formation of cracks in the coating.

The invention claimed is:

1. A device comprising:

a metal plate; and an element for supporting the metal plate, wherein the metal plate is coated with a sol-gel coating, and wherein a thickness of the coating is in a range of 25 to 60 micrometers, further wherein a portion of the metal plate coated with the sol-gel coating is wrapped, via mechanical deformation, around the supporting element without the formation of cracks in the coating.

2. The device according to claim 1, wherein the thickness of the coating is lower than 50 micrometers.

3. The device according to claim 1, wherein the portion of the metal plate coated with the sol-gel coating that is subjected to mechanical deformation comprises an edge along a circumference of the metal plate wrapped around the supporting element.

4. The device according to claim 1, constituting at least a part of an iron in which the metal plate having the coating applied thereto is intended to be used for contacting objects to be subjected to an ironing process and transferring heat to these objects.

5. The device according to claim 1, wherein a heat-conducting material is present between the metal plate and the supporting element.

6. The device according to claim 1, wherein the metal plate is manufactured of stainless steel.

7. The device according to claim 1, wherein the supporting element is manufactured of die-cast aluminum.

8. A method of manufacturing a device having a metal plate and an element for supporting the metal plate comprising:

applying a sol-gel coating to the metal plate, the sol-gel coating having a thickness in a range of 25 to 60 micrometers; and attaching the metal plate coated with the sol-gel coating to the supporting element by subjecting at least a portion of the metal plate to a process of mechanical deformation to thereby wrap the portion of the metal plate coated with the sol-gel coating around the supporting element without formation of cracks in the coating.

9. The method according to claim 8, wherein the coating is applied having a thickness lower than 50 micrometers.

10. The method according to claim 8, wherein the portion of the metal plate coated with the sol-gel coating that is subjected to mechanical deformation comprises a bent edge along a circumference of the metal plate, and wherein the bent edge is wrapped around the supporting element.

11. The method according to claim 8, wherein, prior to applying the sol-gel coating to the metal plate, the method further comprising:

subjecting the metal plate to at least one pre-treatment, wherein the pre-treatment includes one selected from the group consisting of sandblasting and annealing.

12. The method according to claim 8, wherein, prior to attaching the metal plate to the supporting element, the method further comprising:

applying a heat-conducting material to a surface of the supporting element which is to be covered by the metal plate.

13. The method according to claim 8, wherein the metal plate is provided in the form of a stainless steel plate.

14. The method according to claim 8, wherein the supporting element is provided in the form of a die-cast aluminum block.

* * * * *